United States Patent [19]

Matsumoto

[11] 4,109,914

[45] Aug. 29, 1978

[54] GAME STRUCTURE EMPLOYING A REVOLVING TARGET

[75] Inventor: Takao Matsumoto, Tokyo, Japan

[73] Assignee: Tomy Kogyo Co., Inc., Tokyo, Japan

[21] Appl. No.: 698,917

[22] Filed: Jun. 23, 1976

[30] Foreign Application Priority Data

Jul. 4, 1976 [JP] Japan ..... 50-93481[U]

[51] Int. Cl.[2] ..... A63B 63/06

[52] U.S. Cl. ..... 273/101; 273/105.2; 124/7

[58] Field of Search ..... 273/105.2, 101, 95, 273/111; 272/46, 43, 50, 45, 37, 19; 46/137, 139, 140

[56] References Cited

U.S. PATENT DOCUMENTS

| | | | |
|---|---|---|---|
| 61,960 | 2/1867 | Snofford et al. | 273/95 R |
| 460,717 | 10/1891 | Fisk | 273/101 |
| 1,080,299 | 12/1913 | Richmond | 273/95 R |
| 1,632,692 | 6/1927 | Blackburn | 272/37 |
| 1,656,272 | 1/1928 | Ekstein | 273/120 R |
| 2,657,057 | 10/1953 | Chapin | 273/101 |
| 3,066,938 | 12/1962 | Walz | 273/101 |
| 3,395,920 | 8/1968 | Moe | 273/101 |
| 3,594,000 | 7/1971 | Glass | 273/1 R |

FOREIGN PATENT DOCUMENTS

| | | | |
|---|---|---|---|
| 453,967 | 1/1927 | Fed. Rep. of Germany | 272/34 |
| 254,838 | 5/1948 | Switzerland | 273/101 |

OTHER PUBLICATIONS

Mr. Mouth, "TV", Tomy 1976 Catalog, p. 15.

*Primary Examiner*—Richard C. Pinkham
*Assistant Examiner*—Lawrence E. Anderson
*Attorney, Agent, or Firm*—Edward D. O'Brian

[57] ABSTRACT

An effective game or game structure can be constructed so as to utilize a receptacle rotatably mounted on a base member. A lid is pivotally mounted on the receptacle so as to be capable of being pivoted between opened and closed positions by a cam and cam follower structure as this receptacle revolves. At least one propulsion structure is located remote from the receptacle so that an individual using the game can attempt to propel a projectile into the receptacle as the receptacle is rotated and as the lid is periodically opened and closed.

9 Claims, 6 Drawing Figures

GAME STRUCTURE EMPLOYING A REVOLVING TARGET

BACKGROUND OF THE INVENTION

The invention set forth in this specification pertains to new and improved games or game structures. More specifically it pertains to a type of game structure in which a player attempts to propel an appropriate game piece or projectile into a rotating receptacle as a lid is moved so as to periodically open and close the receptacle.

It will, of course, be recognized that probably an untold number of different games have been intended in the past. It has been long recognized that different types of games are preferable to other types of games for various specific play purposes and for use by various different age groups. One type of game which has proved particularly satisfactory for indoor play purposes by children and to some extent others is a game frequently referred to by the name "tiddly winks". In this type of game one or more individuals try to flip or propel game pieces or projectiles into an appropriate receptacle through the use of other playing pieces manipulated in such a manner as to press down upon the first mentioned game pieces.

This type of game is considered to be comparatively disadvantageous for use by comparatively young children. Frequently such children do not possess and/or cannot readily develop the desired degree of coordination necessary to propel or flip a playing piece into a receptacle by pressing down upon the playing piece with another playing piece. Further, because this game does not employ any moving parts other than the playing pieces, it does not tend to hold the attention of a child over a comparatively prolonged period. It is considered that a recognition of these factors has led to the development of a number of different prior games intended to make essentially "tiddly wink" type games more acceptable.

Certain of these prior games have involved the utilization of propulsion means such as spring loaded levers and/or release mechanisms for propelling playing pieces toward a target. It is considered, however, that the majority of efforts at improving "tiddly wink" type games has been devoted to modifying the receptacles used for such games. It is known to utilize a series of concentric rings indicating various point values as a receptacle in this type of game. It is also known to utilize target like receptacles in this type of game employing doors which open and close and concentric members one of which rotates to obtain a shutter like effect.

It would be possible to encumber this specification with a further detailed description of such games and the various related game structures. Although at least several efforts have been made to provide game structures which have the effect of opening and closing a target or receptacle it is not considered that such structures are as effective as desired in providing an attention getting effect which will tend to maintain the attention of comparatively small children. It is further considered that such structures have tended to be of such a nature as to be undesirably hard for a child to use so that a projectile is propelled into them or tend to be too easy for a child to propel a projectile into them. In this field if a child finds it either too easy or too difficult to accomplish a task involved in playing a game the child is apt to not wish to utilize the game to any significant extent.

BRIEF SUMMARY OF THE INVENTION

It is believed that it will be apparent from the preceding that the invention is intended to provide a new and improved game or game structure. Broadly speaking the invention is directed toward providing a game or game structure which may be manufactured at a comparatively nominal cost, which may be easily and conveniently used by children, which is capable of prolonged reliable operation, and which is of such a nature that it is capable of effectively holding the attention or interest of children. The invention is also directed to a new and improved target structure which, if desired, may be referred to as a game structure having the various characteristics indicated in the preceding sentence.

A game structure in accordance with this invention comprises: a base member, a receptacle having an open top rotatably mounted on the base member, a lid pivotally mounted on the receptacle so as to be capable of being moved between an opened position in which the opened top of the receptable is exposed and a closed position in which the opened top of the receptacle is covered, rotating means for rotating the receptacle on said base member connecting said receptacle and said base member and lid lifting means for periodically moving said lid between said opened and closed positions as said receptacle is rotated.

A game structure in accordance with this invention preferably is also constructed so as to include a plurality of propulsion means for propelling a projectile serving as a game piece toward the receptacle. Preferably such propulsion means are mounted on the base at various spaced intervals around the receptacle. Although a plurality of different automatically operating lid lifting means can be used with the invention, preferably the lid lifting means employed involves a cam mounted on the base and a follower movably mounted on the receptacle in such a manner that the follower engages the lid so as to move the lid between the positions noted.

BRIEF DESCRIPTION OF THE DRAWINGS

Further details of the invention are best indicated with reference to the accompanying drawings in which.

Figure 1:
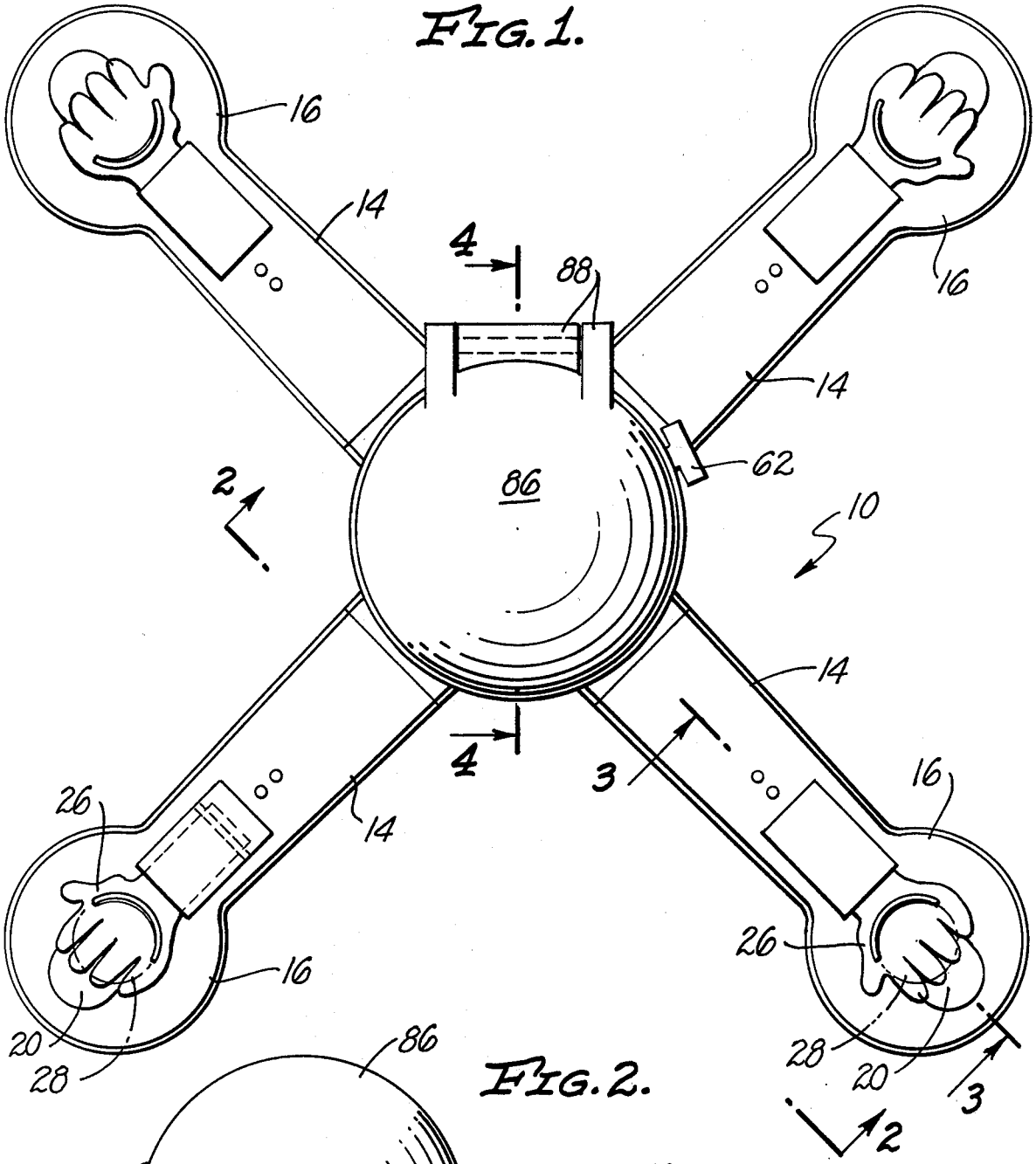
FIG. 1 is a top-plan view of a presently preferred embodiment or form of a game or game structure in accordance with this invention with a lid employed in this structure in a closed position.

The specific structure illustrated in the drawing is constructed so as to utilize the concepts or principles set forth in the appended claims. Those skilled in the design and construction of toys will realize that these concepts or principles can be embodied within a wide variety of differently appearing and differently constructed toys through the use or exercise of routine toy design skill.

DETAILED DESCRIPTION

In the drawing there is shown a game or game structure 10 in accordance with this invention which includes a centrally located base member 12 adapted to rest upon an appropriate supporting surface (not shown). This base 12 is of a generally circular shape and is connected in any convenient manner to four radial arms 14 of identical construction. These arms 14 are located equidistant from one another around the base 12 and terminate in enlarged ends 16 serving as launching sites.

Each of these ends 16 is provided with a slot 18 separating a lower sloping stop surface 20 from an upper stop wall 22. At each of the ends 16 a resilient leaf spring 24 is attached to the end 16 so as to extend generally through the slot 18. These springs 24 are secured in a conventional manner to generally hand shaped levers 26 which are adapted to support and hold disk shaped playing pieces 28 (such a piece 28 is shown in phantom in FIG. 2). With this structure a piece 28 may be located on a lever 26 and this lever 26 may be pulled down against the surface 20. Then when the lever 26 is released the disk 28 held in it will be propelled upwardly as the action of the spring 24 brings the lever 26 into contact with the wall 22.

It will be noted that all of these levers 26 are oriented so that a piece 28 propelled by any of them will be directed generally toward a somewhat cup shaped receptacle 30. This receptacle 30 has a lower cylindrical wall 32 fitting concentrically within an upstanding cylindrical wall 34 on the base 12 around a continuous concentric, cylindrical wall 36 provided with a continuous cam surface 38 having a plurality of cam lobes (not separately numbered). The receptacle 30 also includes an interior wall 40 extending across the wall 32 a short distance above the wall 36 and another false wall 42 serving as a false bottom within this receptacle 30.

The base 12 includes a centrally located upstanding cylindrical post 44 which extends through an opening 46 in the wall 40. This post 44 is secured to a concentric spur gear 48 extending around its periphery. This spur gear 48 in effect serves as a flange serving to support the wall 40 in such a manner that the wall 32 is located a short distance above the base 12 so that the receptacle 30 is capable of being rotated.

Such rotation is accomplished through the use of a small electric motor 50 mounted upon the wall 40. This motor 50 is connected to a partial gear train 52 mechanically connected to another partial gear train 54 mounted upon the wall 40 above the wall 36 and the base 12. A small battery 56 located upon a conventional holder 58 is used to supply power to the motor 50 so as to operate this motor 50 when a switch 60 is closed. This switch 60 is mounted upon the wall 40 and includes an appropriate conventional actuator 62 extending through an opening (not shown) in the receptacle 30 to the exterior of this receptacle 30. With this structure the various gears (not separately numbered) constituting the partial gear train 54 act as planetary gears with respect to the gear 48 so as to cause the receptacle 30 to rotate as the switch 60 is closed.

During such rotation the wall 42 is caused to rotate because of the manner in which it is held within the interior of the receptacle 30. Preferably this wall 42 is supported within the interior of this receptacle 30 by a plurality of support posts 66 carried by the wall 40. Screws 68 are conveniently utilized to mount this wall 42 on these posts 66. In order to facilitate replacement of the battery 56 a portion 70 of the wall 42 may be pivotally attached to the remainder of this wall 42 by means of hinges 72.

The wall 42 is provided with an upwardly directed cylindrical bearing 74 which is in alignment with a hole 76 in the wall 40 which also serves as a bearing. This hole 76 and the bearing 74 support an elongated rod 78 having an enlarged, rounded, upper end 80. This rod 78 has a rounded lower end 82 which rides upon the cam surface 38.

Figure 2:
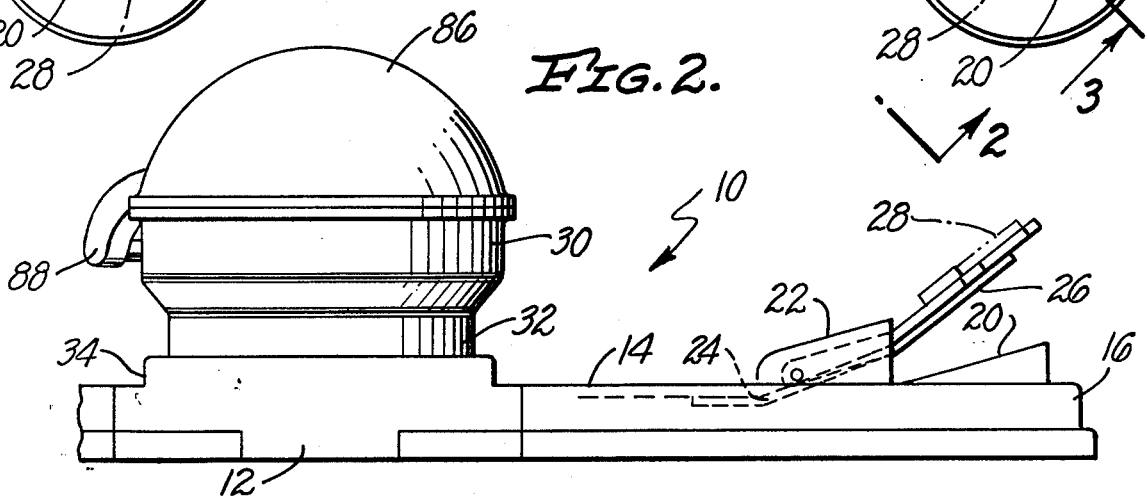
FIG. 2 is a partial cross-sectional view taken at line 2—2 of FIG. 1.
Figure 6:
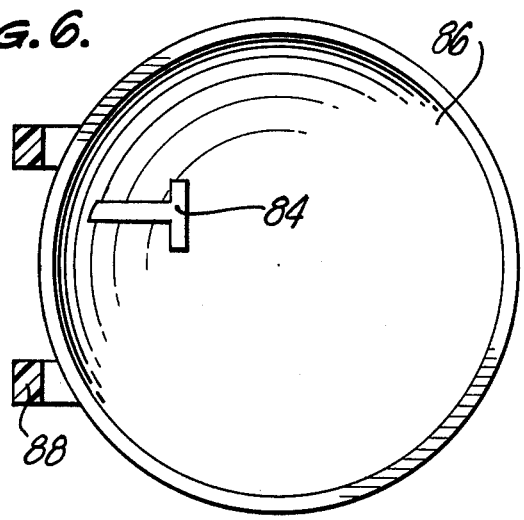
FIG. 6 is a partial cross-sectional view taken at line 6—6 of FIG. 4.
Figure 4:
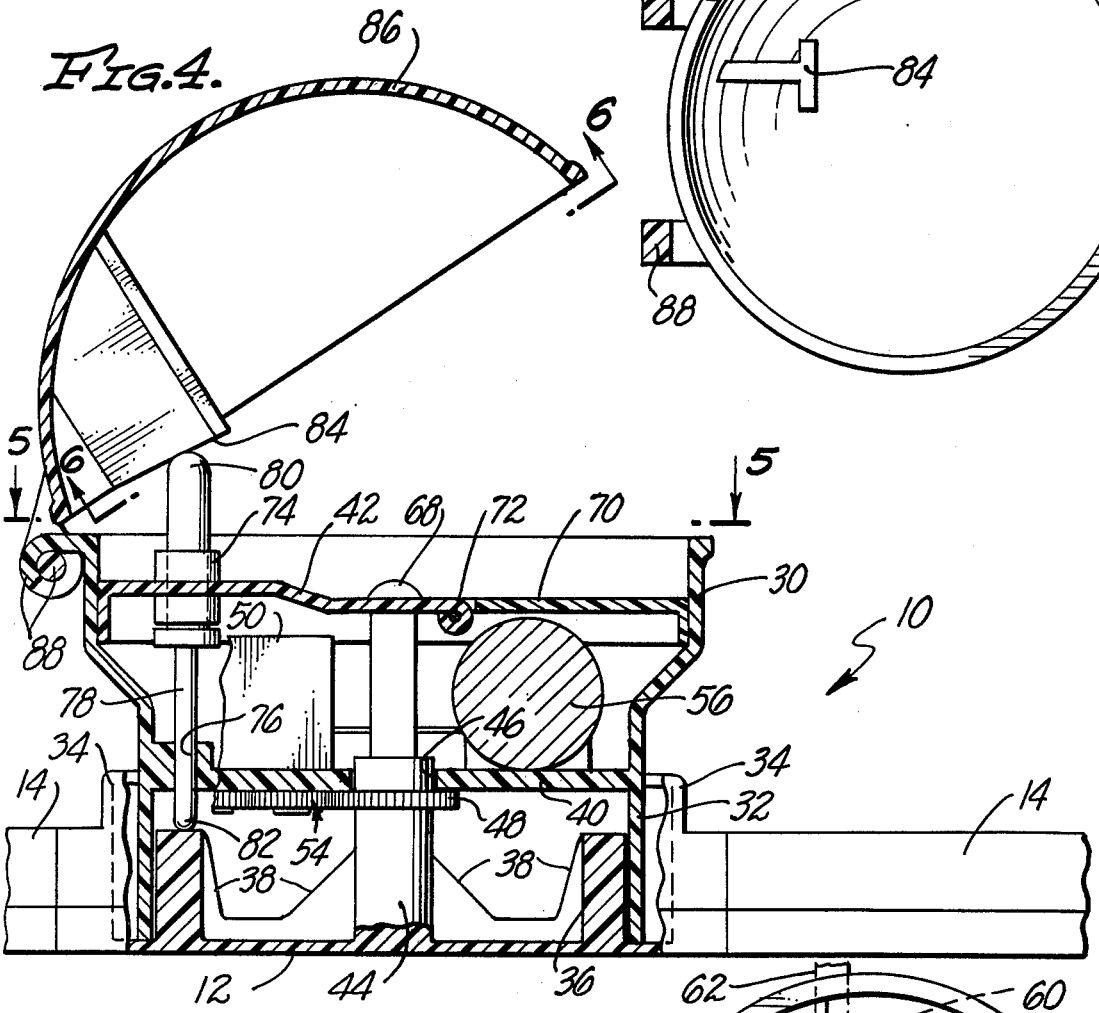
FIG. 4 is a partial cross-sectional view in which certain parts are illustrated in elevation corresponding to a view taken at line 4—4 of FIG. 1, but differing from such a view in that the lid illustrated is shown in an open position.
Figure 5:
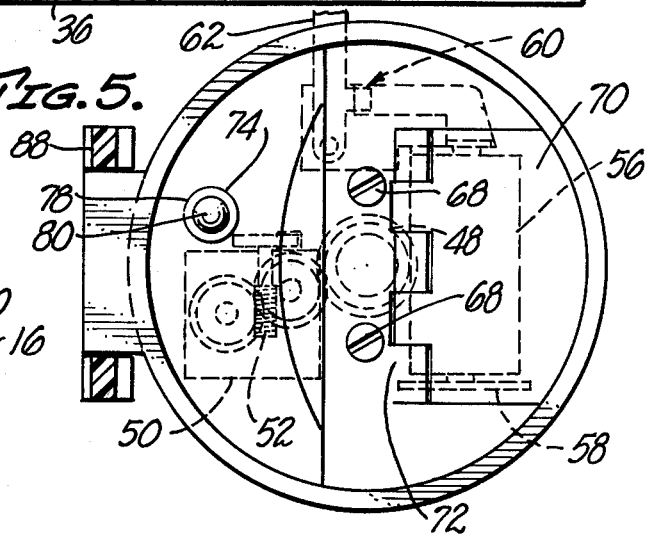
FIG. 5 is a partial cross-sectional view taken at line 5—5 of FIG 4.
Figure 3:
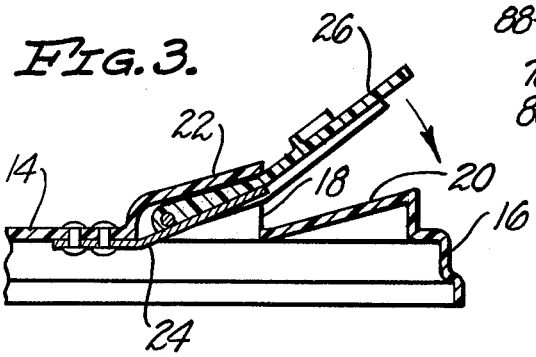
FIG. 3 is a partial cross-sectional view at an enlarged scale taken at line 3—3 of FIG. 1.

With this construction as the receptacle 30 rotates the rod 78 will be turned about the axis of rotation of the receptacle 30 in such a manner that the relative position of the rod 78 will be turned about the axis of rotation of the receptacle 30 in such a manner that the relative position of the rod 78 will be determined by the cam surface 38. This cam surface 38 is shaped so that during such rotation of the receptacle 30 the lower end 82 will act as a follower in order to cause the upper end 80 to push against a bearing plate 84 located within a generally shell-like lid 86. This lid 86 is connected to the receptacle 30 by means of a conventional hinge 88 in such a manner that as the receptacle 30 is rotated the lid 86 will be moved back and forth between a closed position as indicated in FIGS. 1 and 2 of the drawing and an opened position as indicated in FIG. 4 of the drawing.

The cam surface 38 is preferably arranged so that the lid 86 is gradually moved so as to be opened to a reasonable but not a full extent each time that the receptacle 30 is rotated so that the lid 86 as opened will face one of the arms 14. Further, the cam surface 38 is arranged so that the lid 86 will be closed approximately midway between any two of the arms 14. The exact rate of opening and closing may be varied as desired. The objective of the opening and closing of the lid 86 is to provide a comparatively restricted time period when the receptacle 30 is rotating for the reception within this receptacle 30 on the wall 42 of playing pieces 28. As the game 10 is played one or more users can endeavor to propel or flip their respective playing pieces 28 into the receptacle 30. When a plurality of users are playing the game 10 the user getting the maximum number of pieces 28 within this receptacle 30 within a reasonable time period is considered the winner of the game 10. These pieces 28 can, of course, be removed from the receptacle 30 by manually opening the lid 86.

If desired, the receptacle 30 as mounted upon the base 12 together with the other parts previously described which cause this receptacle 30 to rotate and the lid 86 to periodically move between opened and closed positions may be considered as a target or target structure. Obviously the structure involving the moving receptacle 30 can be utilized with other than the springs 24 and levers 26 serving as propulsion means in the game 10. These particular propulsion means are considered desirable in a game of the type described because of their simplicity and because a moderate degree of skill is needed in order to cause the playing pieces 28 to be "tossed" toward the receptacle 30. It is considered that the moving receptacle 30 and the associated structure can be utilized in various differently designed games in which an object such as a ball or bean bag are thrown or tossed toward this type of target structure.

I claim:

1. A game structure which comprises:

a base member, a receptacle having an open top rotatably mounted on said base member so as to rotate about a vertical axis extending through said receptacle, a lid capable of covering said open top of said receptacle pivotally mounted on said receptacle adjacent to said open top so as to be capable of being moved between an open position in which said open top of said receptable is exposed and a closed position in which said open top of said receptacle is covered, rotating means for rotating said receptacle on said base member connecting said receptacle and said base member, and lid lifting means for periodically moving said lid between said open and closed positions as said receptacle is rotated, said lid lifting means comprising a cam surface located on said base, cam follower means extending between said lid and said base for periodically causing said lid to move between said opened and closed positions during rotation of said receptacle, a projectile capable of being projected into said open top of said receptacle when said lid is open.

2. A game structure which comprises:

a base member, a receptacle having an open top rotatably mounted on said base member, a lid pivotally mounted on said receptacle adjacent to an edge thereof so as to be capable of being moved between an open position in which said open top of said receptacle is exposed and a closed position in which said open top of said receptacle is covered, rotating means for rotating said receptacle on said base member about a vertical axis extending through said top connecting said receptacle and said base member, and lid lifting means for periodically moving said lid between said open and closed positions as said receptacle is rotated, an arm attached to said base member so as to extend outwardly from said receptacle, a propulsion means for propelling a game piece toward said receptacle, said propulsion means being mounted on said arm remote from said receptacle.

3. A game structure as claimed in claim 2 wherein: said propulsion means includes a spring means capable of supporting a game piece and capable of being placed under compression so as to be released to propel said game piece and means limiting the movement of said spring member.

4. A game structure as claimed in claim 2 including:

a plurality of said arms extending from said base member, said arms extending outwardly from said receptacle and being spaced from one another, a plurality of said propulsion means, one of said propulsion means being located on each of said arms so as to be remote from said receptacle and wherein, said lid lifting means serves to cause said lid to move between said opened and closed positions a plurality of times each time said receptacle completes one revolution.

5. A game structure as claimed in claim 4 wherein:

said lid lifting means serves to lift said lid so that said lid is in said opened position adjacent to each one of said arms.

6. A game structure as claimed in claim 4 wherein:

said lid lifting means comprises:

a cam surface located on said base, said cam surface being provided with a plurality of cam lobes, follower mounting means located on said receptacle remote from the axis of rotation of said receptacle, a follower movably mounted on said follower mounting means and engaging said cam surface and said lid, said cam surface and said follower serving to lift said lid.

7. A game structure as claimed in claim 2 wherein:

said lid lifting means comprises:

a cam surface located on said base, said cam surface being provided with a plurality of cam lobes, follower mounting means located on said receptacle remote from the axis of rotation of said receptacle, a follower movably mounted on said follower mounting means and engaging said cam surface, said follower being capable of being moved by contact with said cam surface during rotation of said receptacle so as to cause said lid to move between said opened and closed positions.

8. A game structure as claimed in claim 4 wherein:

said cam surface is shaped so as to move said follower to cause said lid to move between said opened and said closed positions a plurality of times each time said receptacle completes one revolution.

9. A game structure as claimed in claim 2 wherein:

said game structure includes a plurality of said arms extending from said base member, said arms projecting outwardly from said receptacle and being spaced from one another, a plurality of said propulsion means, one of said propulsion means being located on each of said arms so as to be remote from said receptacle, said lid lifting means comprises:

a cam surface located on said base, said cam surface being provided with a plurality of cam lobes, follower mounting means located on said receptacle remote from the axis of rotation of said receptacle, a follower movably mounted on said follower mounting means and engaging said cam surface, said follower being capable of being moved by contact with said cam surface during rotation of said receptacle so as to engage said lid so as to cause said lid to move between said opened and said closed positions, so that said lid is open facing each of said arms and is closed between said opened positions.

* * * * *